US005105732A

United States Patent [19]

Sheu

[11] Patent Number: 5,105,732

[45] Date of Patent: Apr. 21, 1992

[54] WALL FAN WITH PROCTECTIVE COVER DEVICE

[76] Inventor: Muh-Chuan Sheu, No. 11, Nan-Hsing Rd., Yung-Kang Hsiang, Taiwan

[21] Appl. No.: 618,901

[22] Filed: Nov. 28, 1990

[51] Int. Cl.[5] ..... F04D 25/14

[52] U.S. Cl. ..... 454/350; 454/359; 454/367

[58] Field of Search ..... 98/116, 40.02, 40.29, 98/80, 81, 111, 113, 42.09, 42.1, 41.3; 251/212; 200/51.12, 446

[56] References Cited

U.S. PATENT DOCUMENTS

| | | | |
|---|---|---|---|
| 446,623 | 2/1891 | Lean | 200/446 |
| 745,313 | 12/1903 | Bate | 251/212 |
| 1,022,058 | 4/1912 | Bliss | 200/51.12 |
| 2,812,896 | 11/1957 | Sieradzki | 98/116 |
| 4,094,492 | 6/1978 | Beeman et al. | 251/212 |
| 4,232,595 | 11/1980 | Cox | 251/212 |
| 4,253,384 | 3/1981 | Schmidt et al. | 98/41.3 |
| 4,407,188 | 10/1983 | Thörn | 98/116 |

*Primary Examiner*—Albert J. Makay

*Assistant Examiner*—William C. Doerrler

*Attorney, Agent, or Firm*—Finnegan, Henderson, Farabow, Garrett & Dunner

[57] ABSTRACT

A protective cover device for a wall fan includes a shutter assembly having a first ring plate, a second ring plate with a shape similar to that of the first ring plate, and a plurality of arcuate strips provided between the first and second ring plates. The first and second ring plates define a central opening. Each arcuate strip has a shape corresponding to an arc portion of the first and second ring plates. One end of each arcuate strip is connected to the first ring plate. The other end of each arcuate strip is connected to the second ring plate. The arcuate strips are evenly distributed on the first and second ring plates to form an overlapping arrangement between the first and second ring plates. The second ring plate is limitedly rotated to correspondingly move the arcuate strips between an open position, wherein the arcuate strips are concealed between the first and second ring plates, and a closed position, wherein the arcuate strips extend across the central opening to form an annular cover defining a central aperture.

1 Claim, 8 Drawing Sheets

WALL FAN WITH PROCTECTIVE COVER DEVICE

BACKGROUND OF THE INVENTION

1. Field of the Invention

The invention relates to a cover device for a fan and more particularly to a cover device for a wall fan to protect the wall fan from rain and bad weather.

2. Description of the Related Art

A conventional wall fan is shown in FIG. 1. The wall fan has a casing A having a front opening (not shown) and a rear opening provided with grilles Al. A fan unit is disposed inside the casing A and includes a motor B to control the movement of fan blades C. The rear opening of the casing A serves as an air passage during the operation of the fan. The wall fan is mounted in an opening in a wall of an enclosed space for ventilation. During cold and/or rainy weather, the wall fan is seldom used and thus, the casing A becomes an unnecessary passage in the wall through which undesirables, such as rats, insects, and cold air, can enter the enclosed space. Moreover, over a long period of time, exposure of the wall fan to rain water and bad weather reduces the service life of the wall fan.

SUMMARY OF THE INVENTION

Therefore, the object of the present invention is to provide a wall fan with a protective cover device so that the wall fan can be protected from rain and bad weather to thereby prolong the service life of the fan.

Accordingly, a first preferred embodiment of a protective cover device of the present invention comprises a shutter assembly including a first ring plate, a second ring plate having a shape similar to that of the first ring plate, and a plurality of arcuate strips provided between the first and second ring plates. The first and second ring plates define a central opening. Each arcuate strip has s shape corresponding to an arc portion of the first and second ring plates. One end of each arcuate strip is connected to the first ring plate. The other end of each arcuate strip is connected to the second ring plate. The arcuate strips are evenly distributed on the first and second ring plates to form an overlapping arrangement between the first and second ring plates. The first and second ring plates and the arcuate strips are received in an annular chamber confined by front and rear annular covers. The protective cover device further comprises means for limitedly rotating the second ring plate. The rotating means moves the second ring plate to correspondingly move the arcuate strips between an open position, wherein the arcuate strips are concealed between the first and second ring plates, to a closed position, wherein the arcuate strips extend across the central opening to form an annular cover defining a central aperture.

The front annular cover has an arcuate slot. The limited rotating means includes a rotating mechanism having a bi-directional motor means mounted on the front annular cover, and a sprocket and chain assembly similarly mounted on the front cover and connected to the motor means. A connector member is provided on the second ring plate and projects through the arcuate slot to interconnect the sprocket and chain assembly and the second ring plate.

In a second preferred embodiment of a protective cover device according to the present invention, the second ring plate has a portion with a toothed peripheral edge. The limited rotating means includes a bi-directional motor means and a gear wheel driven by the motor means. The gear wheel engages the toothed peripheral edge to permit rotation of the second ring plate with the gear wheel.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
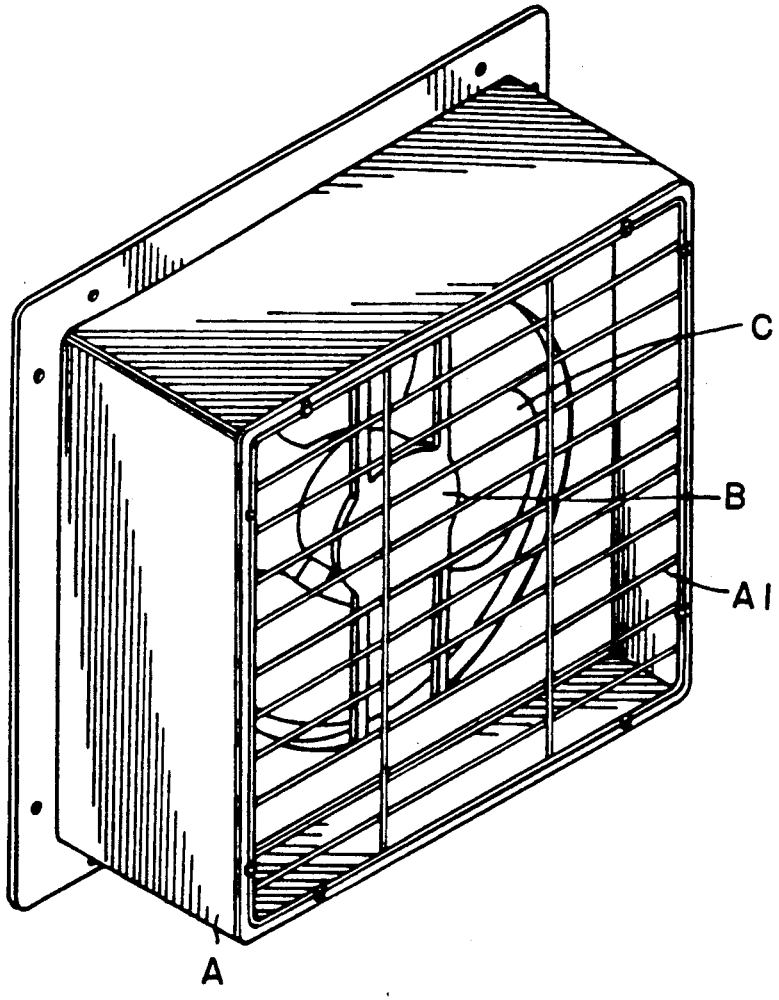
FIG. 1 PRIOR ART
FIG. 1 is an illustration of a conventional wall fan.
Figure 2:
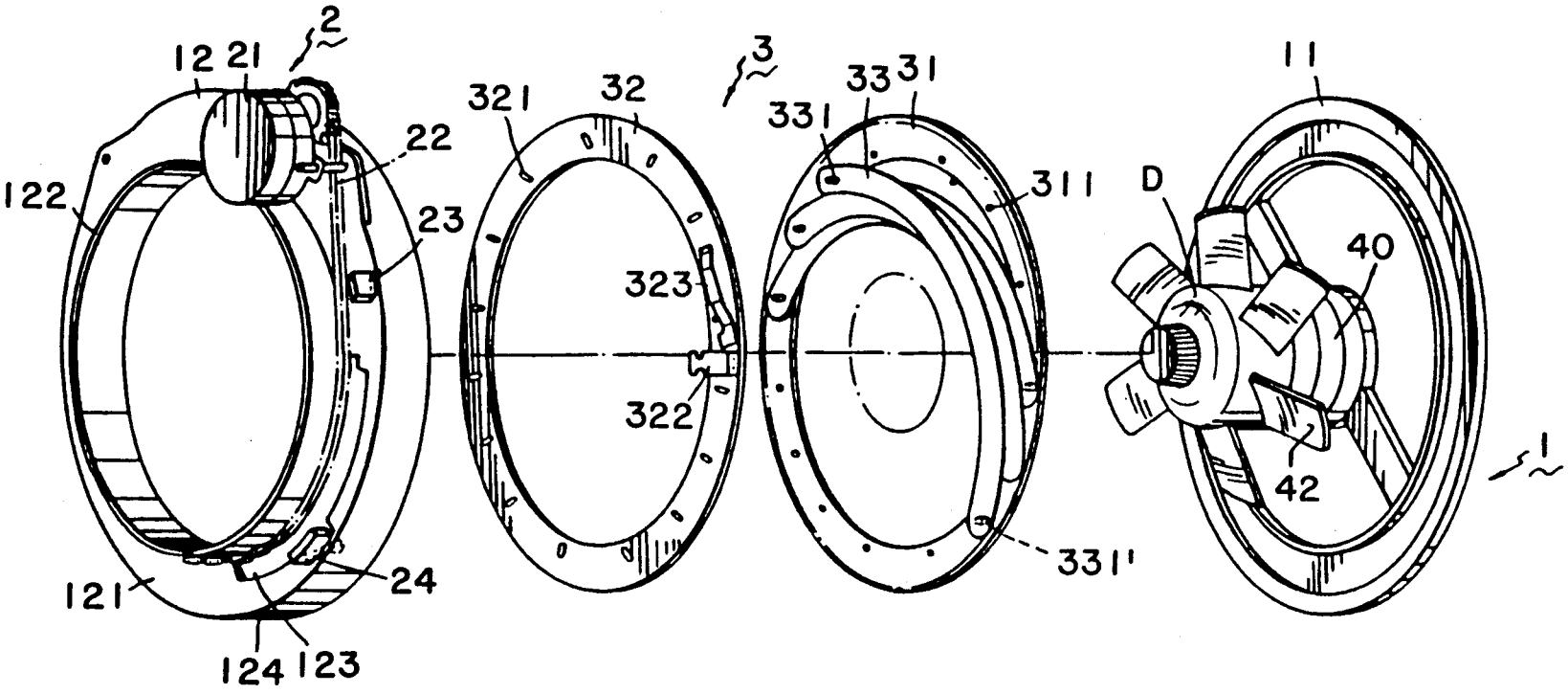
FIG. 2 is an exploded view of a first preferred embodiment of a protective cover device according to the present invention.
Figure 3:
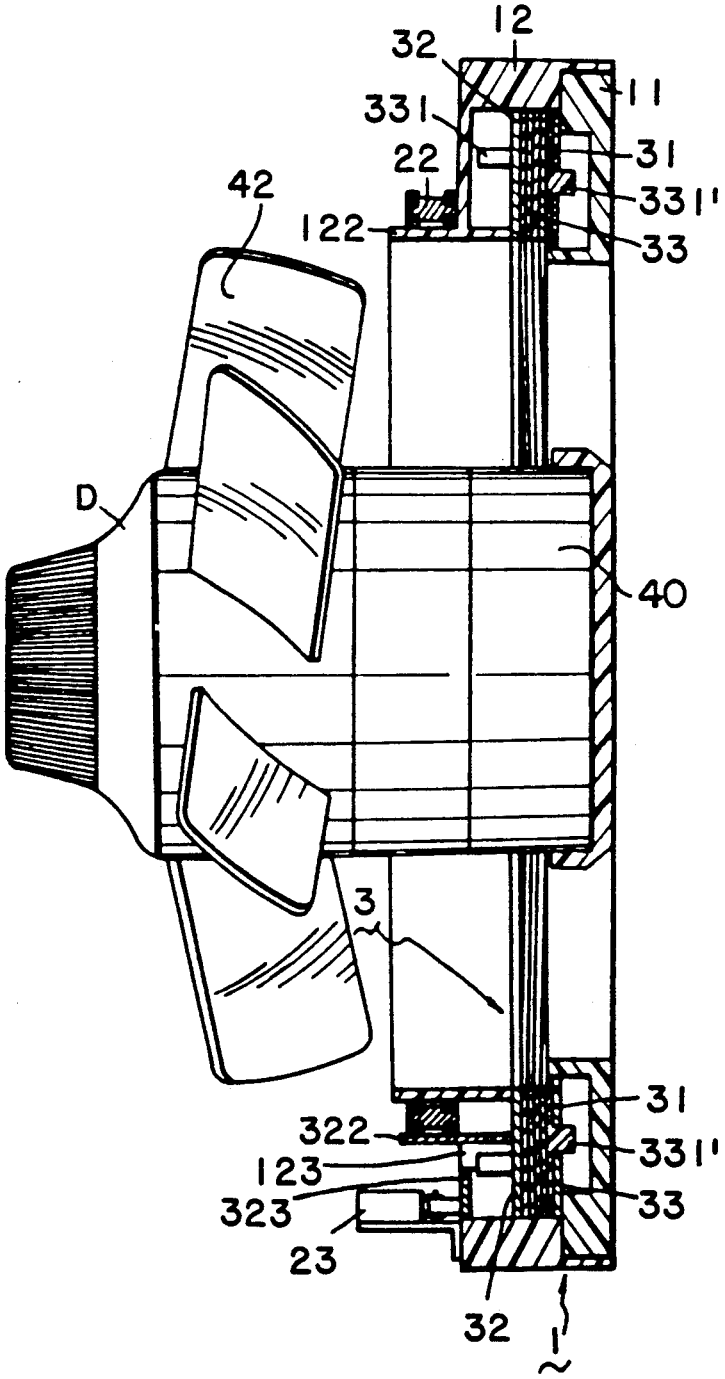
FIG. 3 is a partial sectional view of an assembled first preferred embodiment of a wall fan with the protective cover device of the present invention.

Referring to FIGS. 2 and 3, the first preferred embodiment of the wall fan with protective cover device according to the present invention includes a front annular cover 12 and a rear annular cover 11. A conventional an unit D comprising a motor containing hub 40 and a plurality of fan blades 42 is mounted in the center of the rear annular cover 11. The front annular cover 12 has an annular plate 121 having a first cylindrical flange 122 projecting forwardly and rearwardly from the inner periphery thereof. A second cylindrical flange 124 projects rearwardly from the outer periphery of the annular plate 121. The annular plate 121 further has an arcuate slot 123 disposed adjacent to a portion of the first cylindrical flange 122.

A rotating mechanism 2 is mounted on the front annular cover 12. The rotating mechanism 2 includes a bi-directional motor means 21. Should the motor means 21 encounter some resistance when rotating in one direction, the motor means 21 automatically rotates in the opposite direction. A sprocket and chain assembly 22 is similarly mounted on the front annular cover 12 around the first cylindrical flange 122 and is connected to the motor means 21. A first contact switch 23 is provided on the annular plate 121 between the motor means 21 and one end of the arcuate slot 123. A second contact switch 24 is similarly provided on the annular plate 121 at the arcuate slot 123 adjacent to the other end thereof.

A shutter assembly 3 is received in an annular chamber confined by the front annular cover 12 and the rear annular cover 11. The shutter assembly 3 includes a fixed ring plate 31, a rotary ring plate 32, and a plurality of arcuate strips 33 disposed between the fixed and rotary ring plates 31 and 32. The fixed ring plate 31 is mounted on the annular plate member 11. The surfaces of the fixed and rotary ring plates 31 and 32 are provided with a plurality of evenly distributed mounting holes 311 and 321, respectively. The shape of each arcuate strip 33 corresponds to an arc portion of the fixed and rotary ring plates 31 and 32. One end of each arcuate strip 33 is provided with an upwardly extending stub 331. The other end of each arcuate strip 33 is provided with a downwardly extending stub 331'. The stubs 331 are received in the mounting holes 321 of the rotary ring plate 32, while the stubs 331' are received in the mounting holes 311 of the fixed ring plate 31. The arcuate strips 33 thus form an overlapping arrangement between the fixed and rotary ring plates 31 and 32, as shown in FIG. 2. The rotary ring plate 32 is provided with an outwardly extending connector 322 and a switch actuator 323 disposed adjacent to the connector 322. The connector 322 projects through the arcuate slot 123 of the front annular cover 12 to interconnect the rotary ring plate 32 and the sprocket and chain assembly 22. Rotation of the sprocket and chain assembly 22 thus causes the rotary ring plate 32 to correspondingly rotate. The connector 322 moves along the arcuate slot 123. When further movement of the connector 322 in a first direction is hindered as it reaches one end of the arcuate slot 123, the switch actuator 323 actuates the contact switch 23 or 24 adjacent to said one end of the arcuate slot 123. (The operation of the contact switches 23 and 24 will be discussed in greater detail in the succeeding paragraphs).

Figure 4:
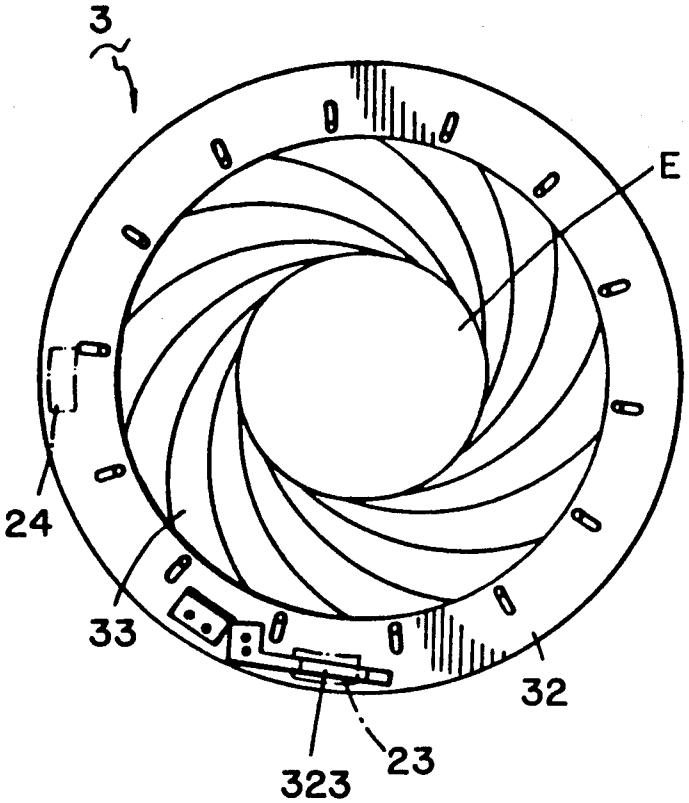
FIG. 4 is a front view of a shutter assembly of the protective cover device of the present invention when fully closed.
Figure 5:
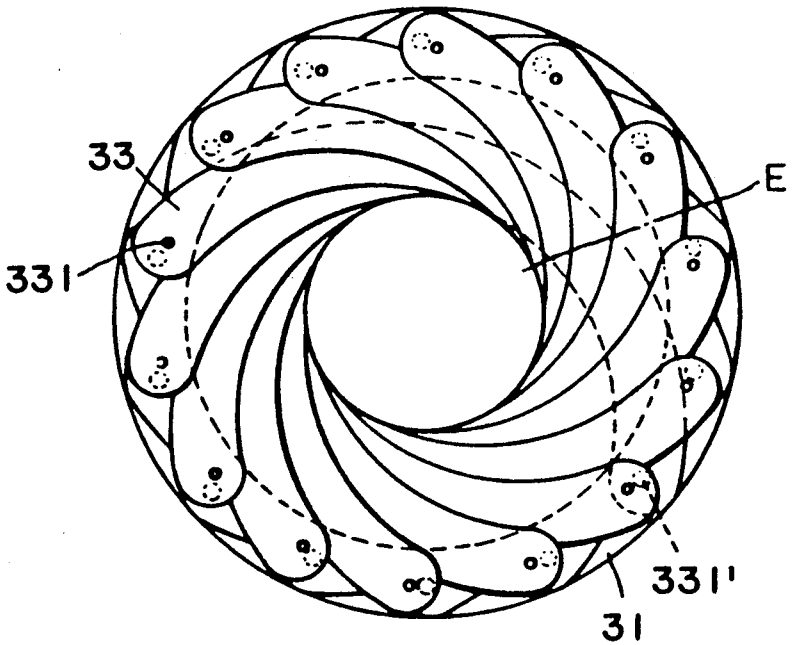
FIG. 5 is a rear view of the shutter assembly shown in FIG. 4.

The shutter assembly 3 moves toward a closed position when the switch actuator 323 moves toward the contact switch 23. FIGS. 4 and 5 are illustrations of the arrangement of the arcuate strips 33 of the shutter assembly 3 when moved by the rotary ring plate 32 to the closed position. The arcuate strips 33 extend across the central opening defined by the fixed and rotary ring plates 31 and 32 to form an annular cover with a central aperture E. The size of the central aperture E defined by the arcuate strips 33 corresponds to the diameter of the fan unit D and can be adjusted by limiting the rotation of the rotary ring plate 32.

Figure 6:
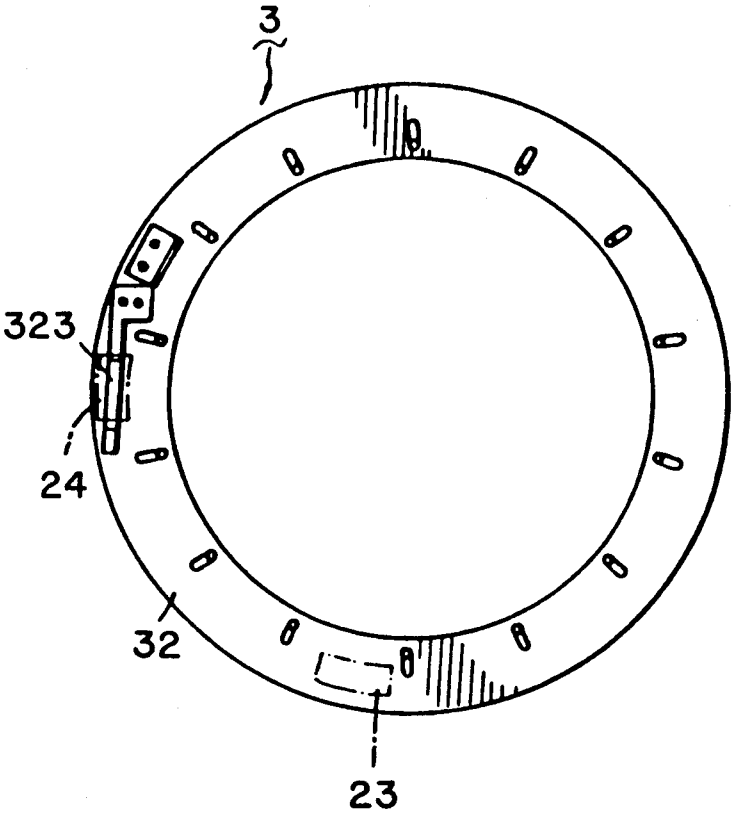
FIG. 6 is a front view of the shutter assembly of the first preferred embodiment when fully opened.
Figure 7:
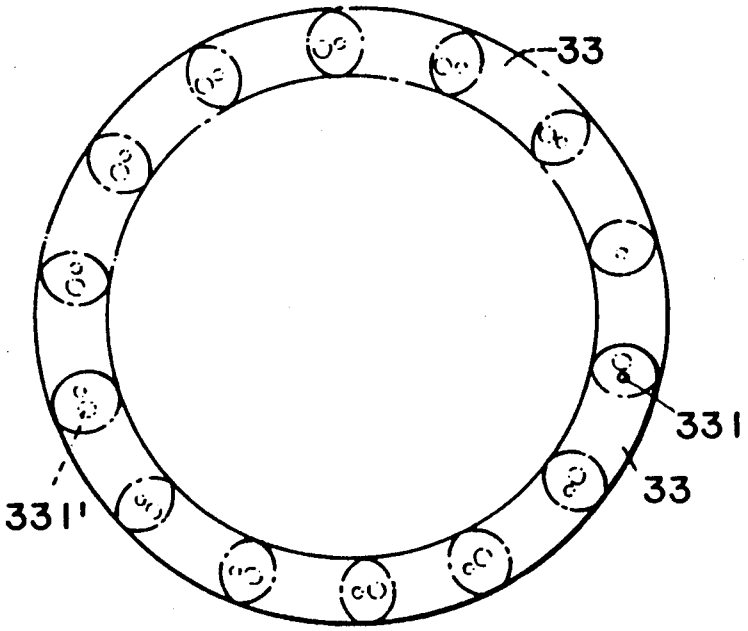
FIG. 7 is a rear view of the shutter assembly shown in FIG. 6.

The shutter assembly 3 is opened when the switch actuator 323 moves toward the contact switch 24. FIGS. 6 and 7 are illustrations of the arrangement of the arcuate strips 33 of the shutter assembly 3 when moved by the rotary ring plate 32 to the open position. The arcuate strips 33 are concealed between the fixed and rotary ring plates 31 and 32 to permit passage of air through the fan unit D.

Figure 8:
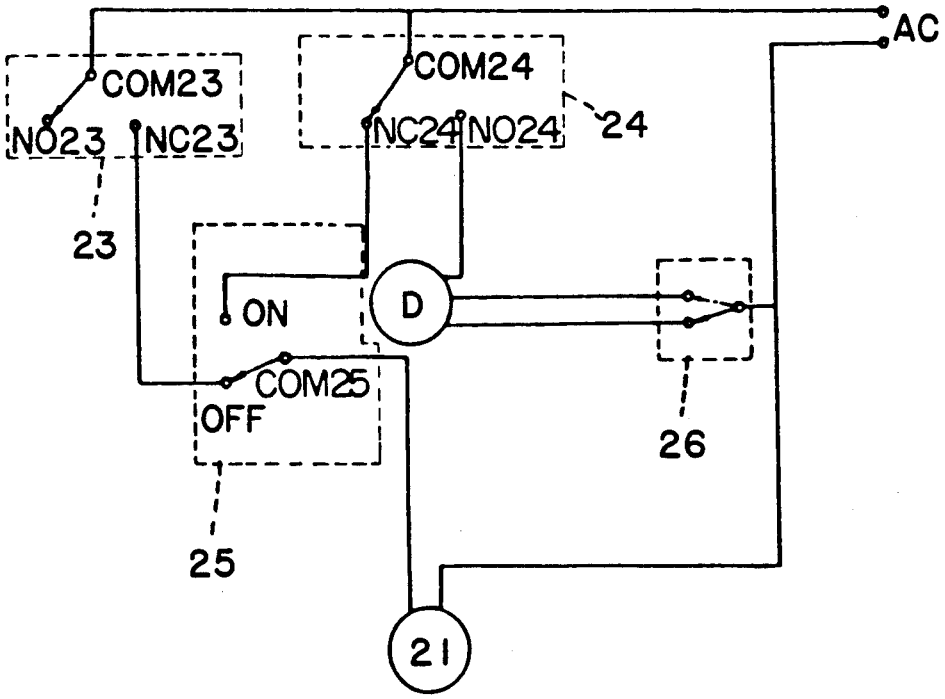
FIGS. 8, 9, 10, and 11 are schematic circuit diagrams of the wall fan incorporating the present invention at different stages of its operation.

FIGS. 8, 9, 10 and 11 are illustrations of the circuit operation of the wall fan incorporating the present invention under four different conditions:

(1) FIG. 8 is a schematic circuit diagram of the wall fan when it is not in use. The shutter assembly 3 is closed and the switch actuator 323 actuates the connect switch 23. Pin COM23 of the contact switch 23 is connected to a pin NO23 thereof. Pin COM24 of the contact switch 24 is connected to a pin NC24 thereof. The circuitry of the wall fan includes a power supply switch 25 and a motor rotational direction select switch 26 (to selectively exhaust or supply air to the enclosed space). When the wall fan is not in use, pin COM25 of the power supply switch 25 is connected to the OFF pin. As shown in this figure, the fan unit D is not in operation since it is not connected to the power supply source AC.

Figure 9:
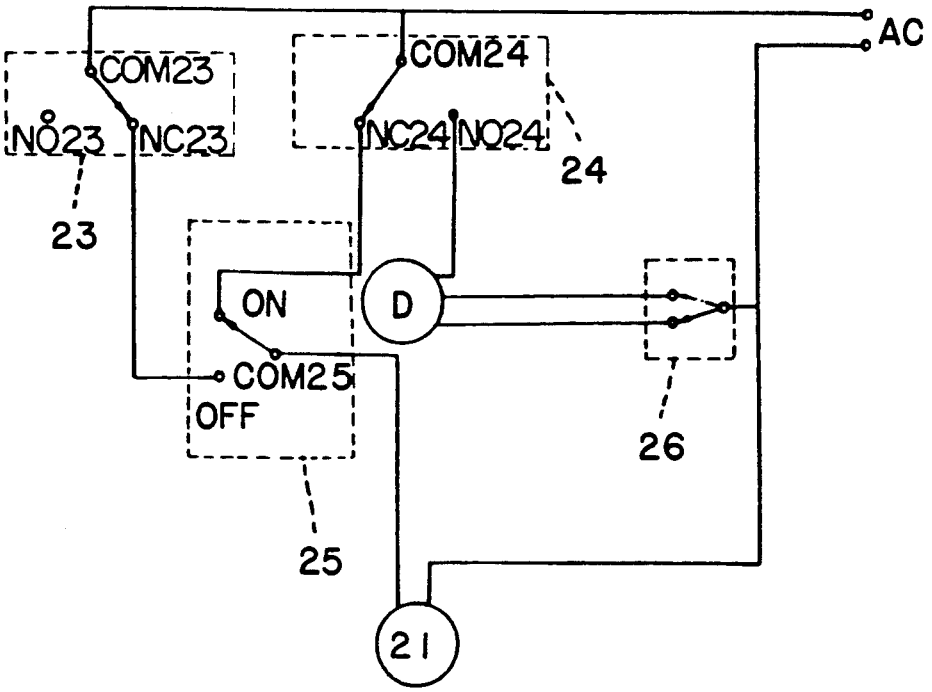

(2) When the power supply switch 25 is switched on, i.e., pin COM25 is connected to the ON pin, as shown in FIG. 9, the motor means 21 is connected to the power supply source AC via the contact switch 24 and the power supply switch 25 to actuate the shutter assembly 3. As the shutter assembly 3 moves toward the open position, the switch actuator 323 ceases to actuate the contact switch 23 and as such, in COM23 of the contact switch 23 is connected to a pin NC23 thereof. Pin COM24 is still connected to pin NC24 since the switch actuator 323 has yet to actuate the contact switch 24. The fan unit D is not yet in operation since it is still not connected to the power supply source AC.

Figure 10:
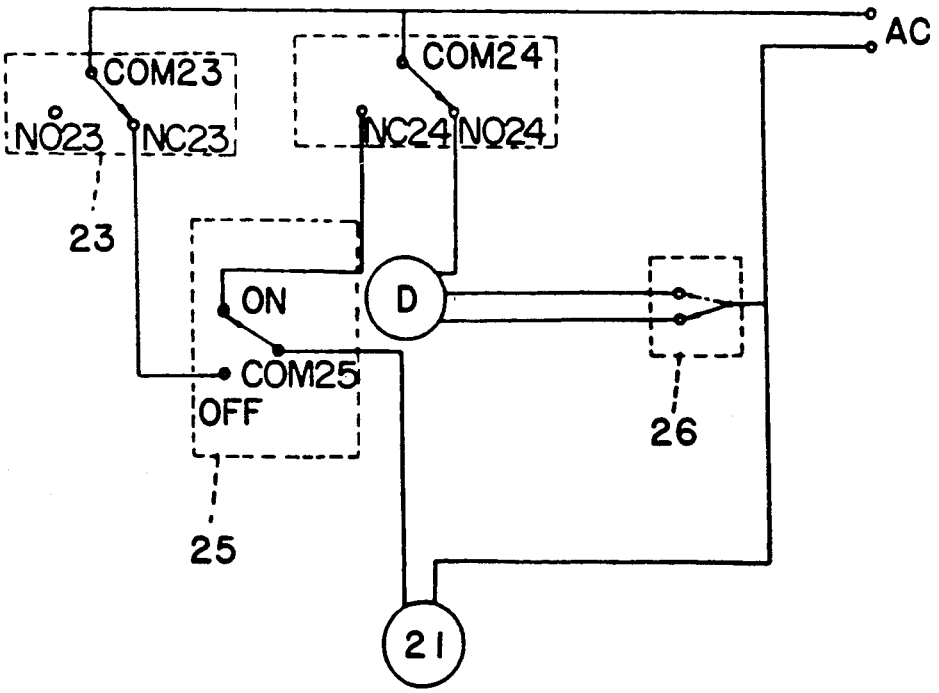

(3) Referring to FIG. 10, when the shutter assembly 3 is fully open, the switch actuator 323 actuates the contact switch 24 and pin COM24 of the contact switch 24 is connected to a pin NO24 thereof. The fan unit D is connected to the power supply source AC via the contact switch 24 while power supply to the motor means 21 is cut-off. Thus, the motor means 21 stops rotating when the shutter assembly 3 is fully open to permit air flow to and from the fan unit D. The motor rotational direction select switch 26 is then operated to selectively exhaust or supply air to the enclosed space.

Figure 11:
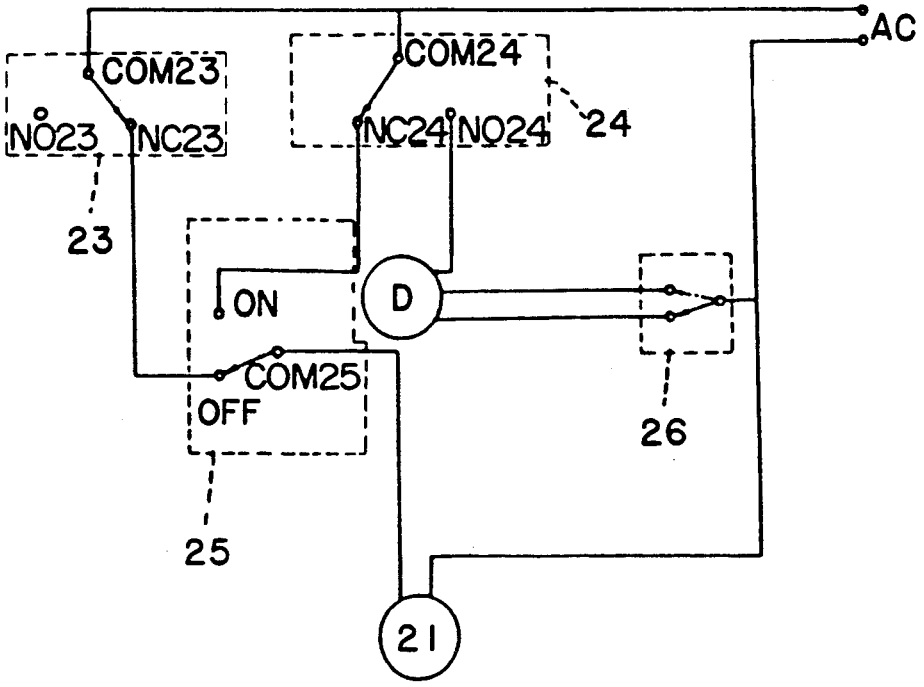

(4) Referring to FIG. 11, when the power supply switch 25 is switched off, power is once more supplied to the motor means 21 via the contact switch 23 and the power supply switch 25 to initiate closing movement of the shutter assembly 3. As the shutter assembly 3 closes, the switch actuator 323 ceases to actuate the contact switch 24 and as such, pin COM24 of the contact switch 24 is once more connected to the pin NC24 thereof. Power supply to the fan unit D is thus cut-off. Pin COM23 remains connected to pin NC23 until the switch actuator 323 actuates the contact switch 23 (i.e., the shutter assembly 3 is fully closed). Power to the motor means 21 is eventually cut-off, as shown in FIG. 8.

It is thus shown that the arrangement of the power supply switch 25 and the contact switches 23 and 24 permit the shutter assembly 3 to automatically open or close before and after operating the fan unit D. However, to make things simpler, two separate switches may be provided to independently control the operation of the motor means 21 and the fan unit D.

Figure 12:
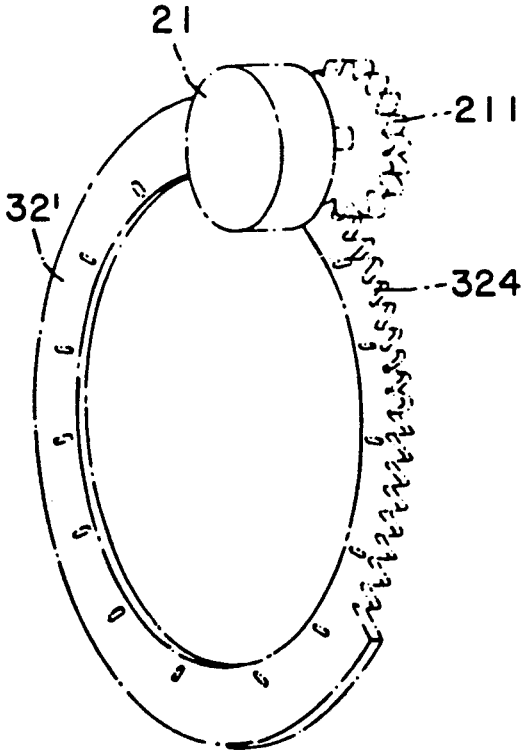
FIG. 12 is an illustration of a portion of a second preferred embodiment of a protective cover device according to the present invention.

The first preferred embodiment can be modified to fit in smaller wall fans such as those provided in computer casings, laboratory instruments and equipment, and the like. In a second preferred embodiment of a protective cover device according to the present invention, a portion of which is shown in FIG. 12, the sprocket and chain assembly 22 and the connector 322 of the first preferred embodiment are replaced by a toothed peripheral edge portion 324 provided on the rotary ring plate 32'. The toothed peripheral edge portion 324 engages a gear wheel 211 of the motor means 21. The operation of the second preferred embodiment is similar to that of the first preferred embodiment and will not be detailed further.

While the present invention has been described in connection with what is considered the most practical and preferred embodiments, it is understood that this invention is not limited to the disclosed embodiments, but is intended to cover various arrangements included within the spirit and scope of the broadest interpretation so as to encompass all such modifications and equivalent arrangements.

I claim:

1. A wall fan having a protective cover device, comprising:

a front annular cover and a rear annular cover forming an annular chamber, said front annular cover having an arcuate slot;

an electrically operated fan unit comprising a motor containing hub and rotating fan blades mounted in a central portion of said rear annular cover;

a shutter assembly mounted in said annular chamber, said shutter assembly comprising a first ring plate, a second ring plate having a shape similar to that of said first ring plate, and a plurality of arcuate strips provided between said first and said second ring plates, the motor hub of said fan unit extending through a central opening defined by said first and second ring plates each of said arcuate strips having a shape corresponding to a portion of an arc of said first and second ring plates, one end of each of said arcuate strips being connected to said first ring plate, the other end of each of said arcuate strips being connected to said second ring plate, said arcuate strips being evenly distributed and forming an overlapping arrangement between said first and said second ring plates;

means for limitedly rotating said second ring plate, said limited rotating means moving said second ring plate relative to said first ring plate to correspondingly move said arcuate strips between an open position, wherein said arcuate strips are concealed between said first and said second ring plates, and a closed position, wherein said arcuate strips extend across said central opening to form an annular cover around the motor hub of fan unit;

said limited rotating means including a rotating mechanism having a bi-directional motor means mounted on said front annular cover and a sprocket and chain assembly similarly mounted on said front annular cover and connected to said motor means; a connector member provided on said second ring plate and projecting through said arcuate slot, said connector member interconnecting said sprocket and chain assembly and said second ring plate; and control means electrically connected between the motor of said fan unit, the motor means, and to an electrical power source, said control means including a first contact switch provided on said front annular cover between said motor means and one end of said arcuate slot; a second contact switch similarly provided on said front annular cover in said arcuate slot adjacent to the other end thereof; a switch actuator provided on said second ring plate adjacent to said connector member, said switch actuator correspondingly actuating one of said first and said second contact switches when said connector member reaches either end of said arcuate slot; and a power supply switching means operable between an ON and an OFF state, said second contact switch connecting said motor means to the power source so as to move said arcuate strips to said open position when said power supply switching means is operated from the OFF state to the ON state, said second contact switch disconnecting said motor means from the power source and connecting said motor of said fan unit to said power source when said second contact switch is actuated by said switch actuator, said first contact switch connecting said motor means to the power source so as to move said arcuate strips to said closed position and move said connecting member to stop the actuation of said second contact switch so as to disconnect said motor of said fan unit from the power source when said power supply switching means is operated from the ON state to the OFF state, said first contact switch disconnecting said motor means from the power source when said first contact switch is actuated by said switch actuator.

* * * * *